US009677261B2

(12) United States Patent
Jiang et al.

(10) Patent No.: US 9,677,261 B2
(45) Date of Patent: Jun. 13, 2017

(54) QUICK SIPHON TOILET

(71) Applicant: Feiyu Li, Xiamen, Fujian (CN)

(72) Inventors: Changfa Jiang, Xiamen (CN); Haitao Xu, Xiamen (CN)

(73) Assignee: Feiyu Li, Xiamen (CN)

( * ) Notice: Subject to any disclaimer, the term of this patent is extended or adjusted under 35 U.S.C. 154(b) by 11 days.

(21) Appl. No.: 14/651,938

(22) PCT Filed: Sep. 11, 2013

(86) PCT No.: PCT/CN2013/083340
§ 371 (c)(1),
(2) Date: Jun. 12, 2015

(87) PCT Pub. No.: WO2014/089998
PCT Pub. Date: Jun. 19, 2014

(65) Prior Publication Data

US 2015/0322659 A1 Nov. 12, 2015

(30) Foreign Application Priority Data

Dec. 14, 2012 (CN) ..... 2012 2 0694650 U

(51) Int. Cl.
*E03D 11/08* (2006.01)
*E03D 1/26* (2006.01)
*E03D 1/38* (2006.01)

(52) U.S. Cl.
CPC ..... *E03D 11/08* (2013.01); *E03D 1/266* (2013.01); *E03D 1/38* (2013.01); *E03D 2201/30* (2013.01)

(58) Field of Classification Search
CPC E03D 1/08; E03D 1/082; E03D 1/085; E03D 1/087
See application file for complete search history.

(56) References Cited

U.S. PATENT DOCUMENTS 3,151,338 A * 10/1964 Nunnery ..... E03D 1/00 4/380
4,077,602 A * 3/1978 Klessig ..... F16K 31/124 251/25
6,321,392 B1 11/2001 Sim

FOREIGN PATENT DOCUMENTS

| | | | |
|---|---|---|---|
| CN | 101725174 | A | 6/2010 |
| CN | 101818519 | A | 9/2010 |
| CN | 102587473 | A | 7/2012 |
| CN | 202936868 | U | 5/2013 |
| GB | 364414 | A | 1/1932 |

* cited by examiner

*Primary Examiner* — Janie Loeppke
(74) *Attorney, Agent, or Firm* — Rabin & Berdo, P.C.

(57) ABSTRACT

The present invention provides a quick siphon toilet. The quick siphon toilet comprises a toilet body and a water tank, the toilet body is disposed with a spray waterway to wash the bottom portion of the toilet body and a flush waterway to wash the periphery wall of the toilet body, the bottom portion of the toilet body is disposed with a siphon washing-out pipe, the water tank is disposed with a drain valve, wherein the drain valve is disposed with a first drain outlet connected to the flush waterway and a second drain outlet connected to the spray waterway, the spray waterway is disconnected to the flush waterway. In a condition of same water volume, the present invention has longer siphon time and flushing time and better washing-out effect. And the present invention uses less water based on well flushing function, thus making it water-saving.

4 Claims, 4 Drawing Sheets

QUICK SIPHON TOILET

FIELD OF THE INVENTION

The present invention relates to a bathroom accessory, especially to a quick siphon toilet.

BACKGROUND OF THE INVENTION

Spray siphon type toilets accounts for more percentages in the existing market. A flushing type toilet, as figured in FIG. 1, the toilet body 1' has a flush waterway 11' and a spray waterway 12', the bottom of the toilet body 1' is disposed with a siphon washing-out pipe 13'. The toilet body 1' is usually assembled with a flush water tank 2', the water tank 2' is disposed with an inlet mechanism and a drain valve 21', the inlet mechanism is connected to an inlet pipe, the drain valve 21' is connected to the spray waterway 11' and the flush waterway 12' respectively. Water divides to two part from the drain valve 21' of the water tank 2', one part of the water flows out of the flush waterway 12' to wash the washing surface of the toilet body 1', the other part of the watery flows out of the spray waterway 11' to wash the bottom portion of the toilet body 1' and it also assists the siphon washing-out pipe 12' to form siphon. As the flushing hole of the flush waterway 12' is connected to the air outside, after the flushing of the water to the toilet body 1', under the work of the atmosphere, only the part of the bottom portion of the toilet body 1' under the water seal surface has water, the pipe between the water seal surface and the drain valve 21' is full of air. When the drain valve 21' starts draining, water firstly fills the pipe, then flows out of the flushing hole of the flush waterway 12'. As the water of the pipe is not continuous in the initial of draining, the water flow rate of the spray waterway 11' is lower than the condition that the pipe is full of water. The siphon pipe can not form siphon quickly in the initial of draining, resulting in a waste of water.

SUMMARY OF THE INVENTION

The object of the present invention is to overcome the disadvantages of the existing known technology and provide a quick siphon toilet.

The technical proposal of the present invention is that:

A quick siphon toilet, comprising a toilet body and a water tank, the toilet body is disposed with a spray waterway to wash the bottom portion of the toilet body and a flush waterway to wash the wall of the toilet body, the bottom portion of the toilet body is disposed with a siphon washing-out pipe, the water tank is disposed with a drain valve, wherein the drain valve is disposed with a first drain outlet connected to the flush waterway and a second drain outlet connected to the spray waterway, the spray waterway is disconnected to the flush waterway.

In another preferred embodiment, a check valve is disposed between the first drain outlet and the flush waterway, the check valve is disposed with a first state and a second state: the first state is a state that when the water tank drains, the check valve is open, so that water enters the flush waterway through the first drain outlet, at the same time, water of the water tank enters the spray waterway through the second drain outlet; the second state is a state that when the water tank does not drain, the check valve is closed, so that the spray waterway and the flush waterway are separated in sealing way.

In another preferred embodiment, the water tank is further disposed with an overflow pipe, the drain valve is connected to the flush waterway through the first drain outlet and then the overflow pipe, a check valve is disposed between the first drain outlet and the overflow pipe, the check valve is disposed with a first state and a second state: the first state is a state that when the water tank drains, the check valve is open, so that water enters the flush waterway through the first drain outlet and the overflow pipe, at the same time, water of the water tank enters the spray waterway through the second drain outlet; the second state is a state that when the water tank does not drain, the check valve is closed, so that the spray waterway is separated from the flush waterway and the overflow pipe in sealing way.

In another preferred embodiment, a check valve is disposed in the flush waterway, the check valve is disposed with a first state and a second state: the first state is a state that when the water tank drains, the check valve is open, so that water enters the flush waterway through the first drain outlet, at the same time, water of the water tank enters the spray waterway through the second drain outlet; the second state is a state that when the water tank does not drain, the check valve is closed, so that the spray waterway is separated from the flush waterway in sealing way.

The present invention has advantages as follows:

The quick siphon toilet has the drain valve with a drain inlet, a first drain outlet connected to the flush waterway and a second drain outlet connected to the spray waterway, the spray waterway is separated from the air outside, every time after the flushing, the toilet has pre-saved water for next time's flushing the bottom portion of the toilet body, when flushing starts at the next time, it does not need water of the water tank to fulfill the spray waterway again. In the present invention, siphon happens quickly, at the same time, the water diversion volume of the flushing hole at the protruding edge of the toilet is increased. In a condition of same water volume, the present invention has longer flushing time and better washing-out effect. And the present invention uses less water based on well flushing function, thus making it water-saving.

DETAILED DESCRIPTION OF THE EMBODIMENTS

The present invention will be further described with the embodiments and the drawings.

The First Embodiment

Figure 1:
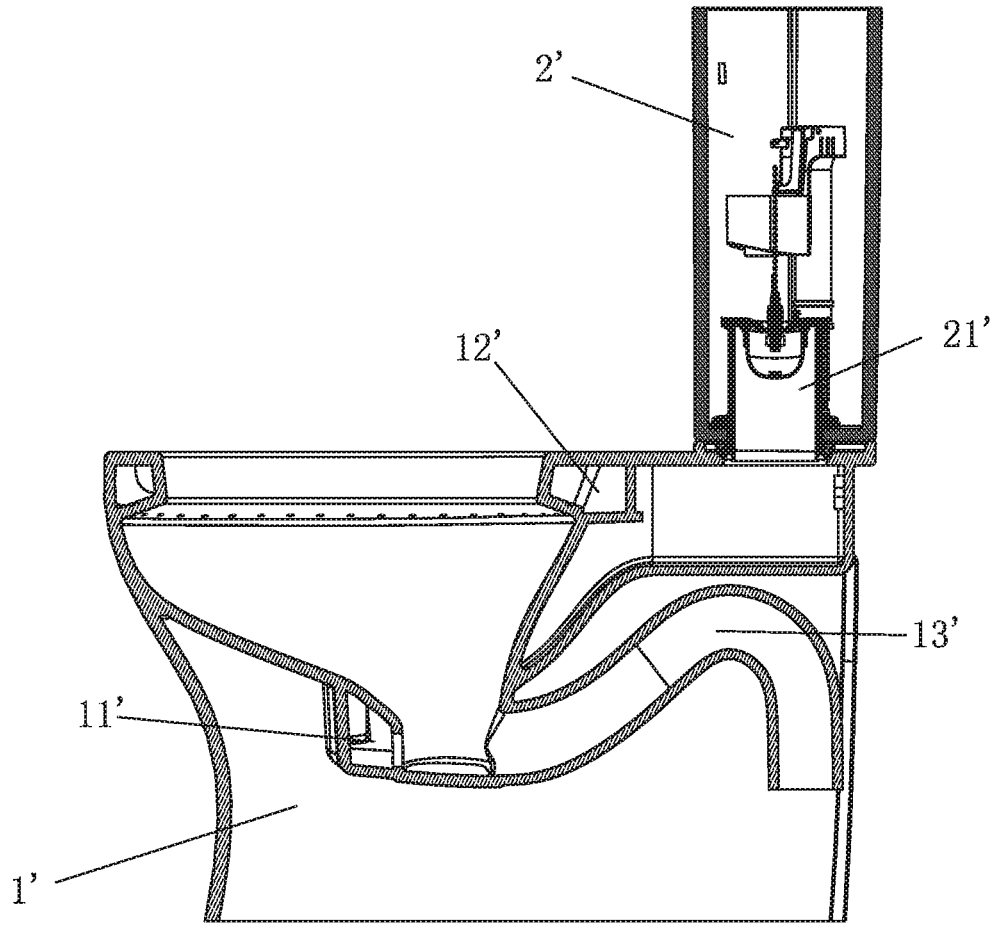
Prior Art FIG. 1
FIG. 1 illustrates a sectional diagram of a flush siphon type toilet of existing known technology.
Figure 2:
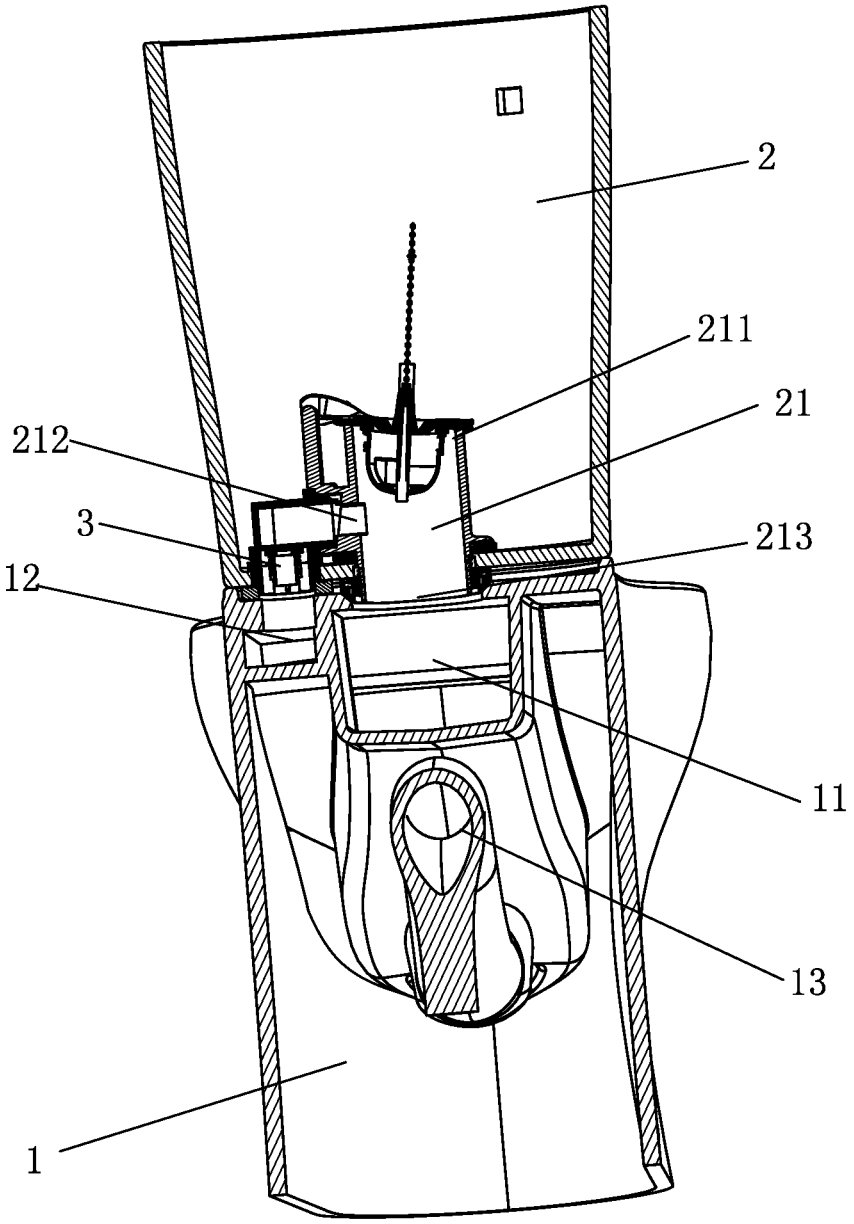
FIG. 2 illustrates a schematic and sectional diagram of a first embodiment of the present invention.

As figured in FIG. 2, a quick siphon toilet comprises a toilet body 1 and a water tank 2, the toilet body 1 is disposed with a spray waterway 11 to wash the bottom portion of the toilet body 1 and a flush waterway 12 to wash the periphery wall of the toilet body 1, the bottom portion of the toilet body 1 is disposed with a siphon washing-out pipe 13, the water tank 2 is disposed with a drain valve 21, the drain valve 21 is disposed with a drain inlet 211, a first drain outlet 212 connected to the flush waterway 12 and a second drain outlet 213 connected to the spray waterway 11. A check valve 3 is disposed between the first drain outlet 212 and the flush waterway 12, the check valve 3 has a first state and a second state: the first state is a state that when the water tank 2 drains, the check valve is open, so that water enters the flush waterway 12 through the first drain outlet 212, at the same time, water of the water tank enters the spray waterway 11 through the second drain outlet; the second state is a state that when the water tank 2 does not drain, the check valve 3 is closed, so that the spray waterway 11 is separated from the flush waterway 12 in sealing way.

When the drain valve 21 drains at the first time, water enters the spray waterway 11 through the second drain outlet 213 to wash the bottom portion of the toilet body 1; water enters the flush waterway 12 through the first drain outlet 212 to wash the periphery wall of the toilet body, the check valve 3 is open under the work of the water flowing. During flushing, water fulfills the spray waterway 11 and the flush waterway 12. After the draining, as the check valve 3 between the first drain outlet 212 and the flush waterway 12 is closed under the work of the gravity and the negative pressure, air can not enter the second drain outlet 213 and the spray waterway 11, the spray waterway 11 is fulfilled or nearly fulfilled.

When the drain valve 21 drains at the second time, water enters the spray waterway 11 through the second drain outlet 213 to wash the bottom portion of the toilet body 1; water enters the flush waterway 12 through the first drain outlet 212 to wash the periphery wall of the toilet body 1, as it does not need water to fulfill the spray waterway 11, the toilet can wash the wash surface earlier and the siphon of the washing-out pipe 13 happens earlier for washing-out. After the draining, as the check valve 3 between the first drain outlet 212 and the flush waterway 12 is closed under the work of the gravity and the negative pressure, air can not enter the second drain outlet 211 and the spray waterway 11, the spray waterway 11 is fulfilled or nearly fulfilled for the next time's operation.

This embodiment has advantages that it can improve the cleaning and washing-out function of the toilet. In a condition of same functions, this embodiment uses less water, thus making it water-saving.

The Second Embodiment

Figure 3:
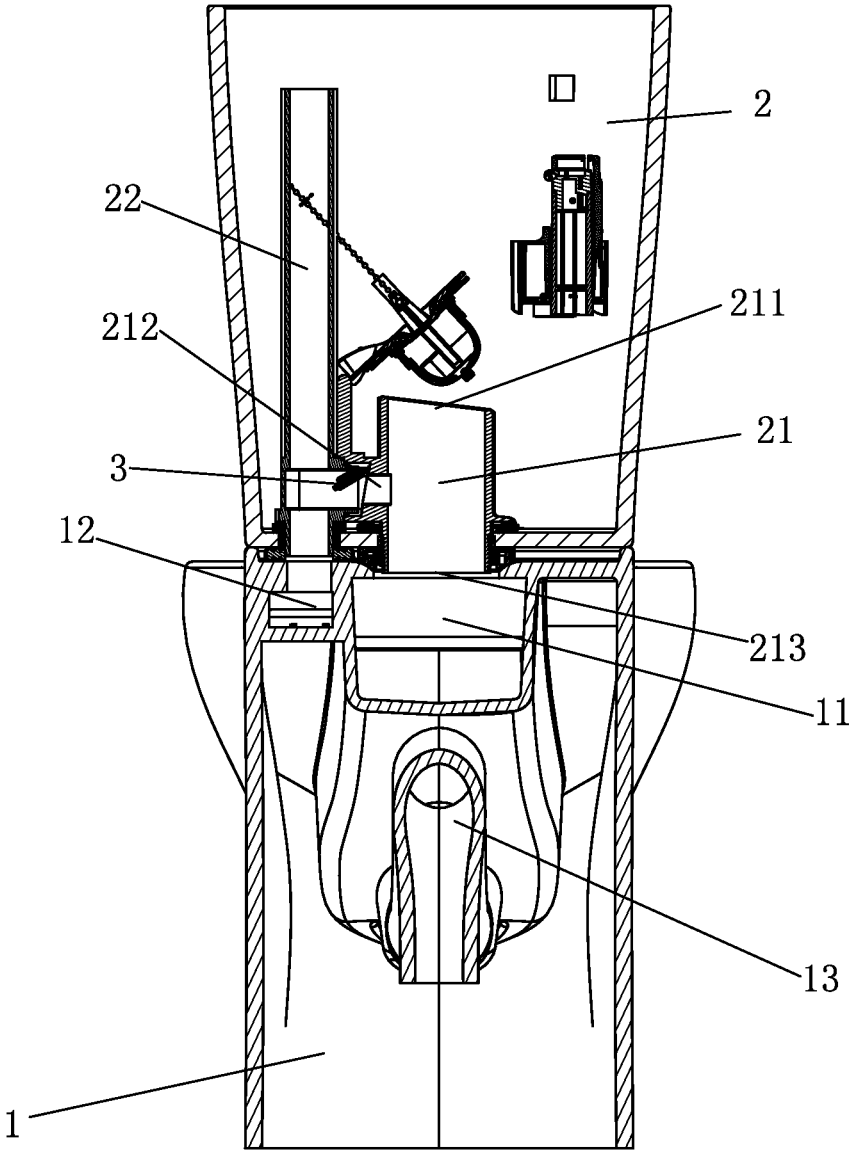
FIG. 3 illustrates a schematic and sectional diagram of a second embodiment of the present invention.

As figured in FIG. 3, a quick siphon toilet comprises a toilet body 1 and a water tank 2, the toilet body 1 is disposed with a spray waterway 11 to wash the bottom portion of the toilet body 1 and a flush waterway 12 to wash the periphery wall of the toilet body 1, the bottom portion of the toilet body 1 is disposed with a siphon washing-out pipe 13, the water tank 2 is disposed with a drain valve 21, the drain valve 21 is disposed with a drain inlet 211, a first drain outlet 212 connected to the flush waterway 12 and a second drain outlet 213 connected to the spray waterway 11. the water tank 2 is further disposed with an overflow pipe 22, the drain valve is connected to the flush waterway 12 through the first drain outlet 212 and the overflow pipe 22, a check valve 3 is disposed between the first drain outlet 212 and the overflow pipe 22, the check valve 3 has a first state and a second state: the first state is a state that when the water tank 2 drains, the check valve is open, so that water enters the flush waterway 12 through the first drain outlet 212 and the overflow pipe 22, at the same time, water of the water tank enters the spray waterway 11 through the second drain outlet 213; the second state is a state that when the water tank 2 does not drain, the check valve 3 is closed, so that the spray waterway 11 is separated from the flush waterway 12 and the overflow pipe 22 in sealing way.

When the drain valve 21 drains at the first time, water enters the spray waterway 11 through the second drain outlet 213 to wash the bottom portion of the toilet body 1; water enters the flush waterway 12 through the first drain outlet 212 to wash the periphery wall of the toilet body, the check valve 3 is open under the work of the water flowing. During flushing, water fulfills the spray waterway 11 and the flush waterway 12. After the draining, as the check valve 3 is closed under the work of the gravity and the negative pressure, air can not enter the second drain outlet 213 and the spray waterway 11, the spray waterway 11 is fulfilled or nearly fulfilled.

When the drain valve 21 drains at the second time, water enters the spray waterway 11 through the second drain outlet 213 to wash the bottom portion of the toilet body 1; water enters the flush waterway 12 through the first drain outlet 212 to wash the periphery wall of the toilet body 1, as it does not need water to fulfill the spray waterway 11, the toilet can wash the wash surface earlier and the siphon of the washing-out pipe 13 happens earlier for washing-out. After the draining, as the check valve 3 is closed under the work of the gravity and the negative pressure, air can not enter the spray waterway 11, the spray waterway 11 is fulfilled or nearly fulfilled for the next time's operation.

This embodiment has advantages that it can improve the cleaning and washing-out function of the toilet. In a condition of same functions, this embodiment uses less water, thus making it water-saving.

The Third Embodiment

Figure 4:
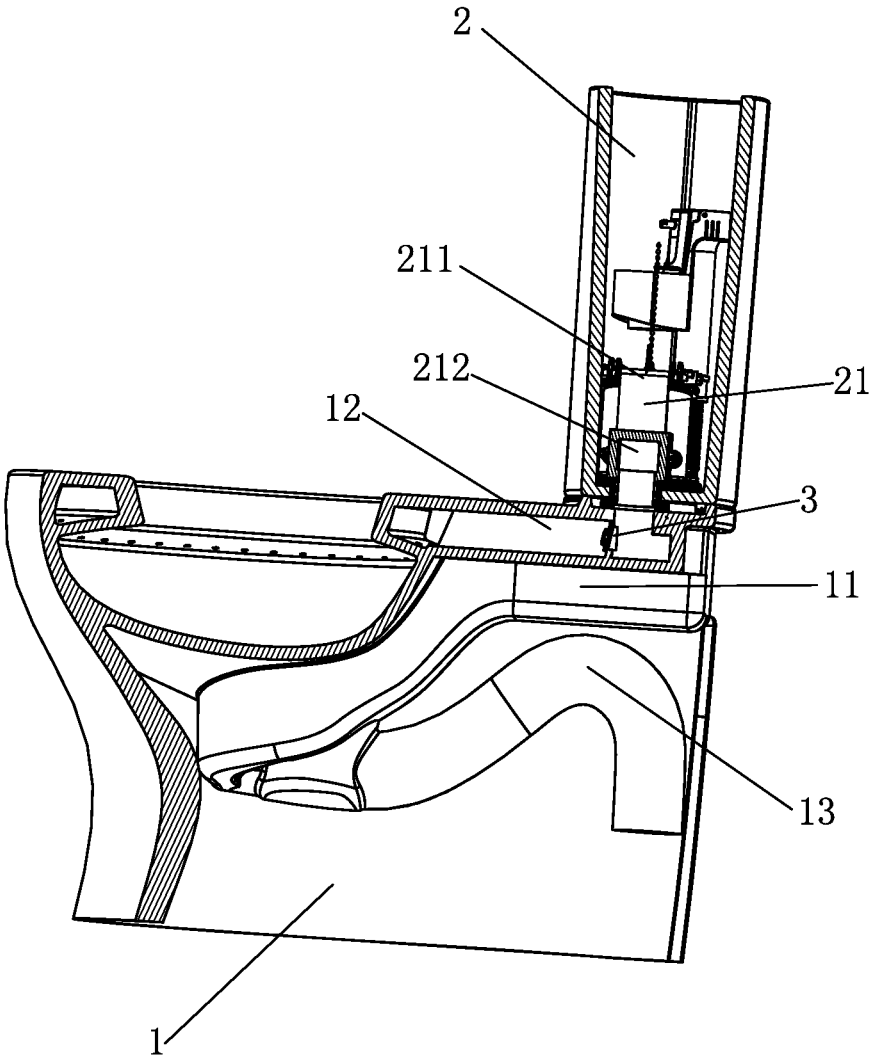
FIG. 4 illustrates a schematic and sectional diagram of a third embodiment of the present invention.

As figured in FIG. 4, a quick siphon toilet comprises a toilet body 1 and a water tank 2, the toilet body 1 is disposed with a spray waterway 11 to wash the bottom portion of the toilet body 1 and a flush waterway 12 to wash the periphery wall of the toilet body 1, the bottom portion of the toilet body 1 is disposed with a siphon washing-out pipe 13, the water tank 2 is disposed with a drain valve 21, the drain valve 21 is disposed with a drain inlet 211, a first drain outlet 212 connected to the flush waterway 12 and a second drain outlet (not figured out) connected to the spray waterway 11. A check valve 3 is disposed in the flush waterway 12, the check valve 3 has a first state and a second state: the first state is a state that when the water tank 2 drains, the check valve is open, so that water enters the flush waterway 12 through the first drain outlet 212, at the same time, water of the water tank enters the spray waterway 11 through the second drain outlet; the second state is a state that when the water tank 2 does not drain, the check valve 3 is closed, so that the spray waterway 11 is separated from the flush waterway 12 in sealing way.

When the drain valve 21 drains at the first time, water enters the spray waterway 11 through the second drain outlet to wash the bottom portion of the toilet body 1; water enters the flush waterway 12 through the first drain outlet 212 to wash the periphery wall of the toilet body, the check valve 3 in the flush waterway 12 is open under the work of the water flowing. During flushing, water fulfills the spray waterway 11 and the flush waterway 12. After the draining, as the check valve 3 is closed under the work of the gravity and the negative pressure, air can not enter the second drain outlet and the spray waterway 11, the spray waterway 11 is fulfilled or nearly fulfilled.

When the drain valve 21 drains at the second time, water enters the spray waterway 11 through the second drain outlet to wash the bottom portion of the toilet body 1; water enters the flush waterway 12 through the first drain outlet 212 to wash the periphery wall of the toilet body 1, as it does not need water to fulfill the spray waterway 11, the toilet can wash the wash surface earlier and the siphon of the washing-out pipe 13 happens earlier for washing-out. After the draining, as the check valve 3 in the flush waterway 12 is closed under the work of the gravity and the negative pressure, air can not enter the spray waterway 11, the spray waterway 11 is fulfilled or nearly fulfilled for the next time's operation.

This embodiment has advantages that it can improve the cleaning and washing-out function of the toilet. In a condition of same functions, this embodiment uses less water, thus making it water-saving.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A quick siphon toilet, comprising a toilet body and a water tank, the toilet body is disposed with a spray waterway to wash the bottom portion of the toilet body and a flush waterway to wash the periphery wall of the toilet body, the bottom portion of the toilet body is disposed with a siphon washing-out pipe, the water tank is disposed with a drain valve in it for draining water from the water tank, wherein the drain valve is disposed with a first drain outlet connected to the flush waterway and a second drain outlet selectively connected to the spray waterway, such that water follows into the spray waterway when connected to the second drain outlet, the water being retained in the spray waterway when the spray waterway is disconnected from the second drain outlet, so as to be used in a subsequent flush, the spray waterway is not directly connected to the flush waterway.

2. The quick siphon toilet according to claim 1, wherein a check valve is disposed between the first drain outlet and the flush waterway, the check valve is disposed with a first state and a second state:

the first state is a state that when the water tank drains, the check valve is open, so that water enters the flush waterway through the first drain outlet, at the same time, water of the water tank enters the spray waterway through the second drain outlet;

the second state is a state that when the water tank does not drain, the check valve is closed, so that the spray waterway and the flush waterway are separated in sealing way.

3. The quick siphon toilet according to claim 1, wherein the water tank is further disposed with an overflow pipe, the drain valve is connected to the flush waterway through the first drain outlet and then the overflow pipe, a check valve is disposed between the first drain outlet and the overflow pipe, the check valve is disposed with a first state and a second state:

the first state is a state that when the water tank drains, the check valve is open, so that water enters the flush waterway through the first drain outlet and the overflow pipe, at the same time, water of the water tank enters the spray waterway through the second drain outlet;

the second state is a state that when the water tank does not drain, the check valve is closed, so that the spray waterway is separated from the flush waterway and the overflow pipe in sealing way.

4. The quick siphon toilet according to claim 1, wherein a check valve is disposed in the flush waterway, the check valve is disposed with a first state and a second state:

the first state is a state that when the water tank drains, the check valve is open, so that water enters the flush waterway through the first drain outlet, at the same time, water of the water tank enters the spray waterway through the second drain outlet;

the second state is a state that when the water tank does not drain, the check valve is closed, so that the spray waterway is separated from the flush waterway in sealing way.

* * * * *